US005456363A

United States Patent [19]

Groppo et al.

[11] Patent Number: 5,456,363

[45] Date of Patent: Oct. 10, 1995

[54] METHOD OF REMOVING CARBON FROM FLY ASH

[75] Inventors: John G. Groppo, Jr., Wilmore, Ky.; Steven M. Brooks, Utica, Mich.

[73] Assignee: University of Kentucky Research Foundation, Lexington, Ky.

[21] Appl. No.: 383,629

[22] Filed: Feb. 6, 1995

[51] Int. Cl.[6] ..... B03D 1/02

[52] U.S. Cl. ..... 209/166; 252/61

[58] Field of Search ..... 209/166, 167; 252/61

[56] References Cited

U.S. PATENT DOCUMENTS

| | | |
|---|---|---|
| 3,589,622 | 6/1971 | Weston . |
| 3,595,390 | 7/1971 | Booth . |
| 3,794,250 | 2/1974 | Brewer . |
| 4,121,945 | 10/1978 | Hurst . |
| 4,392,981 | 7/1983 | Corbeels . |
| 4,426,282 | 1/1984 | Aunsholt . |
| 4,652,433 | 3/1987 | Ashworth . |
| 5,047,145 | 9/1991 | Hwang . |
| 5,227,047 | 7/1993 | Hwang . |

FOREIGN PATENT DOCUMENTS

| | | |
|---|---|---|
| 1167574 | 5/1984 | Canada . |

*Primary Examiner*—Thomas M. Lithgow
*Attorney, Agent, or Firm*—King and Schickli

[57] ABSTRACT

An improved froth flotation method is provided for the removal and recovery of an ultra-fine constituent such as carbon from tailings such as fly ash. A flotation apparatus is utilized that preferably includes a slurry conditioning tank and a flotation cell. The method of the present invention comprises the improvement of utilizing a flotation reagent formulation comprising a mixture of fuel oil and petroleum sulfonate. The method broadly includes the steps of (1) producing a slurry, or solid suspension, of the material containing the constituent to be recovered by adding a preselected amount of water or other slurrying liquid; (2) adding the flotation reagent comprising a mixture of fuel oil and petroleum sulfonate to the slurry that renders the selected constituent hydrophobic; (3) aerating the conditioned slurry; (4) recovering the selected ultra-fine constituent from an upper portion of the flotation apparatus; and (5) withdrawing and recovering tailings from a lower portion of the flotation apparatus.

5 Claims, 1 Drawing Sheet

METHOD OF REMOVING CARBON FROM FLY ASH

TECHNICAL FIELD

The present invention relates generally to an improved froth flotation method for the recovery of a selected ultra-fine constituent, and, more specifically, to an improved froth flotation method for the removal and recovery of carbon from fly ash.

BACKGROUND OF THE INVENTION

Large quantities of fly ash are a by-product when coal is combusted to produce energy in power plants. In the United States alone, the annual production of fly ash is on the order of tens of millions of tons. Significantly, as coal-burning power plants are becoming increasingly relied upon to meet this country's growing energy needs, fly ash production is certain to further increase.

Although fly ash is useful and recyclable in its raw form for a limited number of purposes, including as a bed in road construction, fly ash supply exceeds demand and currently most of the fly ash produced is disposed of as waste. Consequently power plants frequently incur substantial landfill fees for disposing of their unsellable, untreated fly ash. It should, therefore, be appreciated that a need is identified for developing useful markets for fly ash. This will provide the dual benefit of preserving landfill space and reducing utility operating costs.

Toward this end it should be appreciated that fly ash that is low in residual carbon content is an excellent cement additive. Recent clean air regulations have, however, focused upon reducing the. nitrogen oxide ($NO_x$) emissions of electric utility company power plants. As a result, many of these plants now use low $NO_x$ burners. These burners have the unfortunate side effect of increasing the residual carbon content of the fly ash above acceptable levels allowing use of that fly ash as a cement additive. Accordingly, the residual carbon must be removed from the fly ash if the market for fly ash as a cement additive is going to be able to continue to be tapped.

It should also be appreciated that the residual carbon in the fly ash is a high grade product that may be reburned by the coal-fired utilities. Accordingly, if the residual carbon is recovered in an efficient manner, it may be used for recombustion and energy production. Consequently any effective process for separating residual carbon from fly ash provides the multiple benefits of increasing energy production, preparing the fly ash for marketing as a cement additive, reducing or eliminating fly ash disposal costs and preserving landfill space. The present invention proposes utilizing froth flotation to recover the residual carbon from the fly ash and achieve these important benefits of increased economic efficiency and improved resource utilization.

Froth flotation was first discovered in 1906. It was developed for the non-ferrous minerals industry to recover extremely fine, free minerals from slime. This technique, developed nearly 90 years ago, remains basically the same today. The froth flotation mechanism employs the principles of colloid chemistry, crystallography and physics. Separation of one mineral from another is achieved by the use of specific reagents and chemical conditions. The addition of chemical reagents makes one mineral surface hydrophobic through absorption, while leaving the other mineral surfaces hydrophilic. Benification is accomplished by aerating the slurry or suspension, so that air bubbles become laden with hydrophobic particles and rise to the surface of the pulp or slurry, leaving behind the hydrophilic particles. Of course, it should be appreciated that froth flotation is a complex Physico-chemico-mechanical process. The process and, particularly, bubble-particle attachment is influenced by many variables including pH, pulp or slurry density, particle size, bubble size and air flow.

While others have tried to use froth flotation in the past to separate and recover residual carbon from fly ash, they have met with only limited success. This is primarily because prior art efforts have not determined the proper mixture of reagents to promote effective and efficient separation and recovery.

Examples of prior art approaches include U.S. Pat. No. 4,426,282 to Aunsholt which discloses a relatively complex, multi-step method of separating coal or carbon particles from fly ash by flotation at pH levels as low as pH 3–5. The Aunsholt method utilizes a collector, a frother and a dispersant. Preferably, the collector is a mineral oil fraction predominately containing $C_{5-10}$ hydrocarbons. Preferably, the frother is a terpene oil or a cresylic acid and the dispersant is preferably a polyglycolether.

The U.S. Pat. Nos. 5,047,145 and 5,227,047 to Hwang disclose additional methods of recovering carbon from fly ash using fuel oil as a collector in combination with both magnetic separation and flotation techniques.

Notwithstanding these prior efforts, the removal and recovery of carbon from fly ash using conventional froth flotation remains largely an inefficient process. This inefficiency arises in large part because of the excessive amounts of reagents required to render carbon particles hydrophobic. This is likely due to the fine size of the carbon particles as well as their very large surface area. Additionally, methods of flotation in the prior art require a significant amount of flotation time in order to achieve substantial flotation of the carbon particles from the fly ash. Further, carbon flotation systems in the prior art have also proven inadequate in the recovery of significant amounts of higher grade carbon. Thus, a need is identified for a more efficient and effective method of flotation adapted to separate residual carbon from fly ash providing enhanced carbon recovery.

SUMMARY OF THE INVENTION

Accordingly, it is a primary object of the present invention to provide a froth flotation method for removal and recovery of an ultra-fine constituent, such as carbon, from another tailing material, such as fly ash, that overcomes the above-described limitations and disadvantages of the prior art.

Another object of the present invention is to provide a froth flotation method for removal and recovery of carbon from fly ash exhibiting improved efficiency of separation and enhanced recovery of carbon.

An additional object of the present invention is to provide a froth flotation method for removal and recovery of carbon from fly ash that yields significant enhancement of both recovery, that is, the ratio of recovered carbon to total carbon in the original raw feed material and also grade, that is, the ratio of recovered carbon to total recovered material.

Still another object of the present invention is to provide a froth flotation method for removal and recovery of carbon from fly ash that results in a fly ash tailings product that is substantially lower in carbon content and is therefore suitable for use in a larger number of applications, (e.g. cement additive), thereby reducing the amount of unusable fly ash that must be impounded as a waste product.

Yet another object of the present invention is to provide a froth flotation method for removal and recovery of carbon from fly ash that exhibits a significantly faster flotation rate for the carbon particles over the prior art methods.

Yet still another object of the present invention is to provide a froth flotation method for removal and recovery of carbon from fly ash that does not require excessive amounts of flotation reagent to render carbon particles hydrophobic.

Still another object of the present invention is to provide a froth flotation method for removal and recovery of carbon from fly ash that advantageously reduces the amount of reagent required for efficient flotation by utilizing a flotation reagent formulation comprising a mixture of petroleum sulfonate and fuel oil.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved froth flotation method for removal and recovery of an ultra-fine constituent (such as carbon) from a tailings material (such as fly ash) is provided. The froth flotation preferably is accomplished by means of a flotation apparatus that includes a slurry conditioning tank and a flotation cell. Examples of flotation apparatus potentially usable in the present invention include conventional agitation tank flotation systems, column flotation systems and virtually any other type of flotation system used for separation of solid materials that is known in the art.

In accordance with the present invention there is provided a froth flotation method for removal and recovery of carbon from fly ash that includes the following steps. First, a slurry mixture is created by combining raw fly ash with a slurrying liquid, preferably water. Next, a flotation reagent is added to the slurry to render the residual carbon hydrophobic. An agitator may be utilized to increase the efficiency of the resulting conditioning process. This is followed by aerating the slurry by any known means such as through agitation, air injection by bubbling air from a sparger through the slurry or a combination of these. The conditioned carbon particles become hydrophobic. When these conditioned carbon particles collide with air bubbles the particles become attached to the bubbles and rise in the tank. Eventually a froth forms on the surface of the slurry. This froth is removed from an upper portion of the flotation apparatus by skimming off the froth layer. The carbon particles are subsequently recovered from the froth and may be reburned for energy production or recycled for a number of potential applications. Additionally, tailings comprising a low carbon-content fly ash product are recovered from a lower portion of the flotation apparatus and used for a variety of applications such as roadbed construction and cement additives.

According to an important aspect of this invention, the flotation reagent comprises a formulation of fuel oil and petroleum sulfonate. The reagent formulation includes between 20:1 to 5:1 fuel oil to petroleum sulfonate by weight. The preferred ratio is substantially 10:1. Additionally, the quantity of reagent mixture used is preferably 1.0–5.0 pounds of reagent mixture per ton of raw fly ash. Notably, the use of the flotation reagent of the present invention significantly reduces the amount of reagent necessary to achieve adequate flotation and, therefore, separation of carbon particles. Additionally, the petroleum sulfonate/fuel oil formulation produces significantly faster flotation of the carbon particles. Thus, production efficiency/throughout is enhanced. Also, the reagent formulation of the present invention results in a significantly higher grade of floated carbon than in the prior art. This increases energy production upon reburning. Further, the use of the petroleum sulfonate/fuel oil reagent makes it more economically feasible and practical to recover a more useful fly ash product of low carbon-content.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the description will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Figure 2:
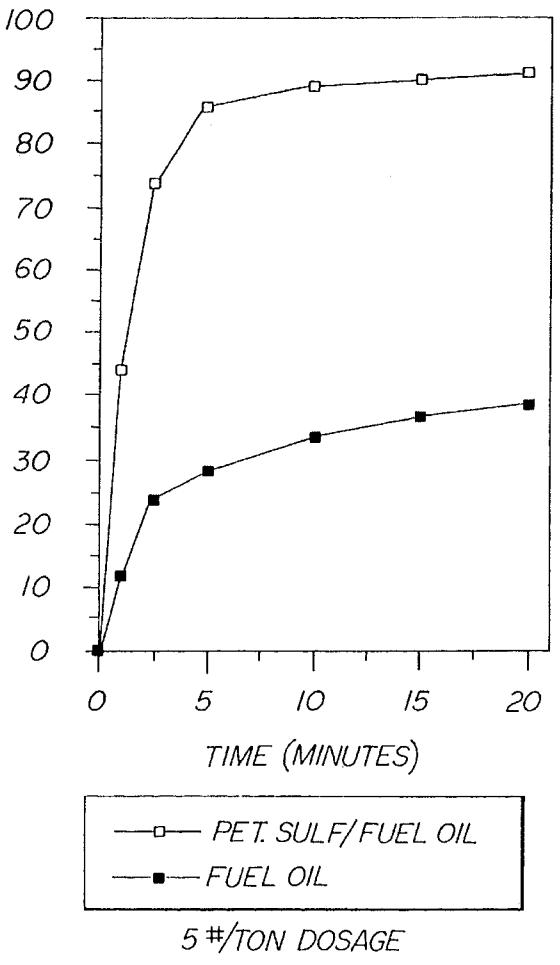
FIG. 2 is a graphical representation demonstrating the cumulative carbon recovery over time provided with the present method as compared with a prior art method using fuel oil alone as the processing reagent.
Figure 1:
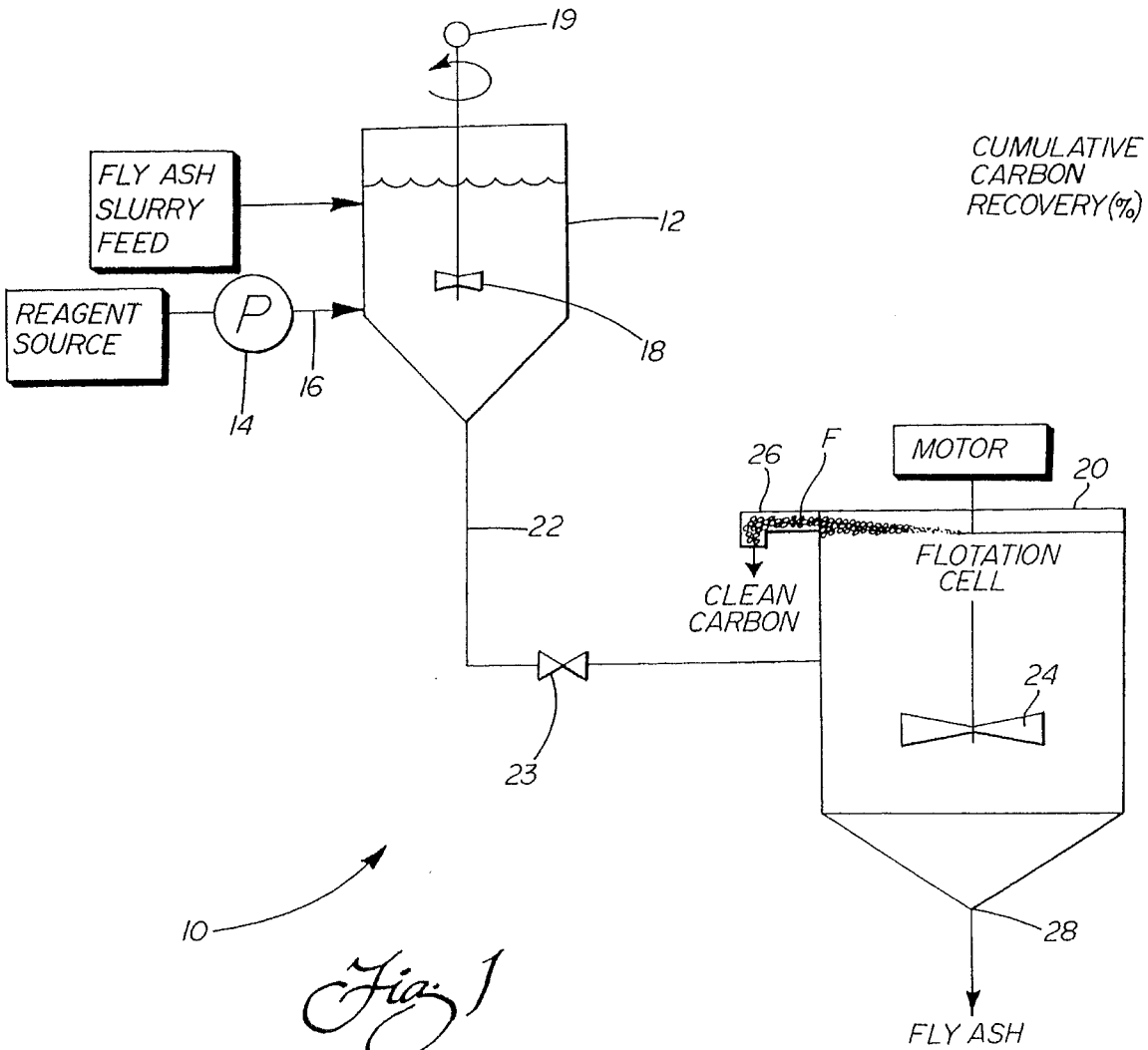
FIG. 1 is a schematical representation of a flotation system of a type generally used in the method of the present invention.

Reference will now be made in detail to the present preferred embodiment of the invention, an example of which is illustrated in the accompanying drawing.

DETAILED DESCRIPTION OF THE INVENTION

In accordance with the present invention, an improved froth flotation method is provided for removal and recovery of a residual ultra-fine constituent from a raw starting material. While the present method is particularly effective in separating carbon from raw fly ash as described in greater detail below, it should be appreciated that it is also equally applicable for other uses and, accordingly, should not be considered as limited to this specific application.

The froth flotation method of the present invention is preferably carried out utilizing one of the several flotation apparatus commonly used and known in this field. Such flotation apparatus include long known and conventional agitation tank flotation systems, column flotation systems and virtually any other flotation system known in the art and used for the separation of solid materials. According to the first step of the present invention, the raw fly ash containing the residual carbon is mixed with a slurrying liquid to produce a slurry. A slurry or solid suspension is preferably formed from about 5% to about 35% by weight raw fly ash and about 65% to about 95% by weight water. This slurry may be either prepared in or introduced into a conditioning tank 12 of a flotation apparatus 10 for further treatment.

Next is the step of adding a flotation reagent to the slurry to condition and thereby render the residual carbon in the raw fly ash hydrophobic. More particularly, the reagent may be pumped by a pump 14 through a feed line 16 for mixing with the slurry. According to an important aspect of this invention, the flotation reagent comprises a formulation of fuel oil and petroleum sulfonate. The flotation reagent formulation may range from 20:1 to 5:1 fuel oil to petroleum sulfonate. Preferably the flotation reagent formulation is substantially of the ratio 10:1 fuel oil to petroleum sulfonate. Additionally, the quantity of reagent mixture used is preferably 5 pounds of reagent mixture per ton of raw fly ash.

Preferably, a rotating agitator or impeller 18 driven by a motor 19 serves to agitate the slurry in the conditioning tank 12. The conditioned slurry may then be transferred to the flotation cell 20 through a feed line 22 including a flow control valve 23. An agitator 24 is provided adjacent a lower end of the cell 20. The agitator 24 may include ports for injecting air into and through the conditioned slurry. As the bubbles rise, the carbon which as been made hydrophobic by conditioning with the reagent collides with and attaches to the air bubbles. Thus, the carbon is carried upwardly in the flotation cell and is gathered in a froth F that collects on the upper surface of the conditioned slurry. This froth F is collected from the overflow 26 thereby allowing recovery of the carbon. As noted above, the recovered carbon is of a high grade and may be reburned for energy production or put to some other use.

A drain 28 at the bottom of the flotation cell allows the withdrawing and recovering of the tailing product, that is, the now treated fly ash. This recovered fly ash has a reduced carbon content and is suitable for use as a cement additive and for other purposes.

By utilizing the novel formulation of the fuel oil/petroleum sulfonate reagent, several important advantages and improvements are realized over prior art flotation reagents and related flotation methods in the recovery of carbon from fly ash. First, the use of the flotation reagent formulation of the present invention significantly reduces the amount of reagent necessary to achieve adequate flotation and separation of carbon particles. At equivalent dosage, the petroleum sulfonate/fuel oil formulation provides as much as three times the carbon removal versus fuel oil alone is the (please refer to graphic representation shown in FIG. 2). Accordingly, the present reagent formulation requires less added reagent to achieve comparable separation and recovery of carbon. Thus, the present reagent yields both reduced reagent handling and capital costs as well as significant improvements in separation efficiency.

Another advantage of using the flotation reagent mixture of the present invention is that the petroleum sulfonate/fuel oil formulation produces significantly faster flotation of the carbon particles from the raw fly ash slurry. For example, research indicates that the petroleum sulfonate/fuel oil formulation provides a higher carbon recovery (44%) after only 1 minute of flotation than an equivalent dosage of fuel oil even after 20 minutes of flotation (38%). Accordingly, separation times are significantly reduced and processing efficiency is greatly enhanced using the flotation reagent mixture of the present invention.

Although the reagent mixture and slurry may be conditioned for up to 5 minutes, practically speaking, any commercial use of this process will likely utilize a conditioning time of no more than 30 seconds before carbon removal is initiated. Because of the rapid separation of carbon during early phases of flotation, the approximate residence time of carbon and fly ash in a given flotation cell is between 5 and 10 minutes. Notably, this residence time represents a marked decrease over residence times required to achieve adequate separation efficiency with prior art separation methods. In fact, the present method achieves throughput at levels upwards of 0.5 lb/min/ft$^3$. This makes processing feasible on a commercial scale.

Another key advantage of the fuel oil/petroleum sulfonate mixture of the present invention is that the grade of the floated carbon is higher than that obtained when using fuel oil alone during the practical range of flotation time. Accordingly, when carbon is removed in accordance with the present method, it is of a higher grade and, therefore, more advantageously suited to efficient recombustion or other use.

Additionally, this method results in a tailing product of fly ash that exhibits a more significant reduction in carbon content than possible with other prior art separation approaches. Consequently, the fly ash recovered during the final step of the present method is usable for a variety of applications such as in cement as an additive, in sound muffling walls, and in roadbed construction. Additionally, landfilling costs are reduced or eliminated and landfilling resources are conserved due to the reduction of the amount of unusable fly ash produced when the reagent mixture of the present invention is utilized.

Briefly summarizing, the froth flotation method for removal and recovery of carbon from fly ash includes the step of preparing a slurry with a preselected ratio of raw fly ash and water or some other slurrying liquid. Next is the adding of a novel reagent comprising a fuel oil/petroleum sulfonate formulation to the slurry. That reagent conditions and renders the residual carbon in the raw fly ash hydrophobic. This is followed by the step of aerating the conditioned slurry, for example, either by air injection or simple agitation. Finally, carbon and a low carbon-content fly ash tailing product are recovered and recycled for further use.

In summary, numerous benefits have been described which result from employing the concepts of the present invention. Advantageously, the method of the present invention provides for improved efficiency of separation and enhanced recovery of residual carbon from raw fly ash. Specifically, the method of the present invention enhances the quantity and quality of recovered unburned carbon as well as yielding a more recyclable fly ash product.

The foregoing description of a preferred embodiment of the invention has been presented for purposes of illustration and description. It is not intended to be exhaustive or to limit the invention to the precise form disclosed. Obvious modifications and variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally and equitably entitled.

I claim:

1. A froth flotation method for the recovery and removal of carbon from raw fly ash containing carbon utilizing a flotation apparatus comprising the steps of:

preparing a slurry of the raw fly ash containing the carbon to be recovered by adding a preselected amount of a slurrying liquid;

adding a flotation reagent to said slurry to condition and thereby render said selected ultra-fine constituent hydrophobic, said flotation reagent comprising a formulation of fuel oil and petroleum sulfonate;

aerating the conditioned slurry;

removing said carbon from an upper portion of said flotation apparatus; and withdrawing and recovering tailings comprising carbon depleted fly ash from a lower portion of said flotation apparatus.

2. The froth flotation method set forth in claim 1, wherein said flotation reagent formulation comprises a ratio of fuel oil to petroleum sulfonate of between substantially 20:1 to 5:1.

3. The froth flotation method set forth in claim 1, wherein said flotation reagent formulation comprises a ratio of substantially 10:1 fuel oil to petroleum sulfonate.

4. The froth flotation method set forth in claim 1, wherein the quantity of flotation reagent used is substantially one to five pounds of reagent per ton of raw fly ash.

5. The froth flotation method set forth in claim 1, wherein said flotation reagent is added to the slurry in a conditioning tank and conditioning of the slurry with the flotation reagent occurs for at least fifteen seconds before passing the now conditioned slurry to the flotation apparatus.

* * * * *